US008522631B2

(12) United States Patent
Suzuki et al.

(10) Patent No.: US 8,522,631 B2
(45) Date of Patent: Sep. 3, 2013

(54) ENGINE STARTER MECHANISM USING ONE WAY CLUTCH

(75) Inventors: Yukiyoshi Suzuki, Fukuroi (JP); Takaya Yamada, Fukuroi (JP)

(73) Assignee: NSK-Warner K.K., Tokyo (JP)

( * ) Notice: Subject to any disclaimer, the term of this patent is extended or adjusted under 35 U.S.C. 154(b) by 152 days.

(21) Appl. No.: 13/089,270

(22) Filed: Apr. 18, 2011

(65) Prior Publication Data

US 2011/0252902 A1 Oct. 20, 2011

(30) Foreign Application Priority Data

Apr. 19, 2010 (JP) ..... 2010-095688

(51) Int. Cl.
*F02N 1/00* (2006.01)

(52) U.S. Cl.
USPC ..... 74/7 C; 74/7 E

(58) Field of Classification Search
USPC ..... 74/6, 7 C, 7 E; 192/42, 46
See application file for complete search history.

(56) References Cited

U.S. PATENT DOCUMENTS

| | | | | |
|---|---|---|---|---|
| 4,178,805 | A * | 12/1979 | Mazzorana | 74/6 |
| 4,534,272 | A * | 8/1985 | Irwin | 91/493 |
| 4,671,125 | A * | 6/1987 | Yabunaka | 74/7 E |
| 5,307,702 | A * | 5/1994 | Spellman et al. | 74/7 E |
| 5,471,890 | A * | 12/1995 | Shiga et al. | 74/7 E |
| 6,857,984 | B2 * | 2/2005 | Imanishi et al. | 475/331 |
| 7,559,303 | B2 * | 7/2009 | Sakai et al. | 123/179.25 |
| 7,900,529 | B2 * | 3/2011 | Suzuki et al. | 74/7 C |
| 8,109,737 | B1 * | 2/2012 | Gamble et al. | 417/397 |
| 8,161,933 | B2 * | 4/2012 | Gast et al. | 123/179.25 |
| 8,267,060 | B2 * | 9/2012 | Suzuki et al. | 123/179.22 |
| 2009/0008190 | A1 | 1/2009 | Suzuki et al. | |

FOREIGN PATENT DOCUMENTS

| | | | |
|---|---|---|---|
| CN | 101400888 | A | 4/2009 |
| JP | 2007-132311 | A | 5/2007 |

OTHER PUBLICATIONS

Office Action issued Jun. 11, 2012 in Chinese Patent Application No. 2011100969204.

* cited by examiner

*Primary Examiner* — David M Fenstermacher
(74) *Attorney, Agent, or Firm* — Miles & Stockbridge P.C.

(57) ABSTRACT

An engine starter mechanism using a one way clutch includes a starter motor; a ring gear for receiving a driving force from the starter motor; the one way clutch including an outer race, an inner race disposed away from the outer race in a radially inner direction and relatively rotatably disposed concentrically with the outer race, and a torque transmitting section disposed between the outer race and the inner race to transmit a torque; and an oil seal for sealing the one way clutch, the ring gear is connected to the outer race of the one way clutch, and the oil seal is held between the ring gear and the outer race.

5 Claims, 1 Drawing Sheet

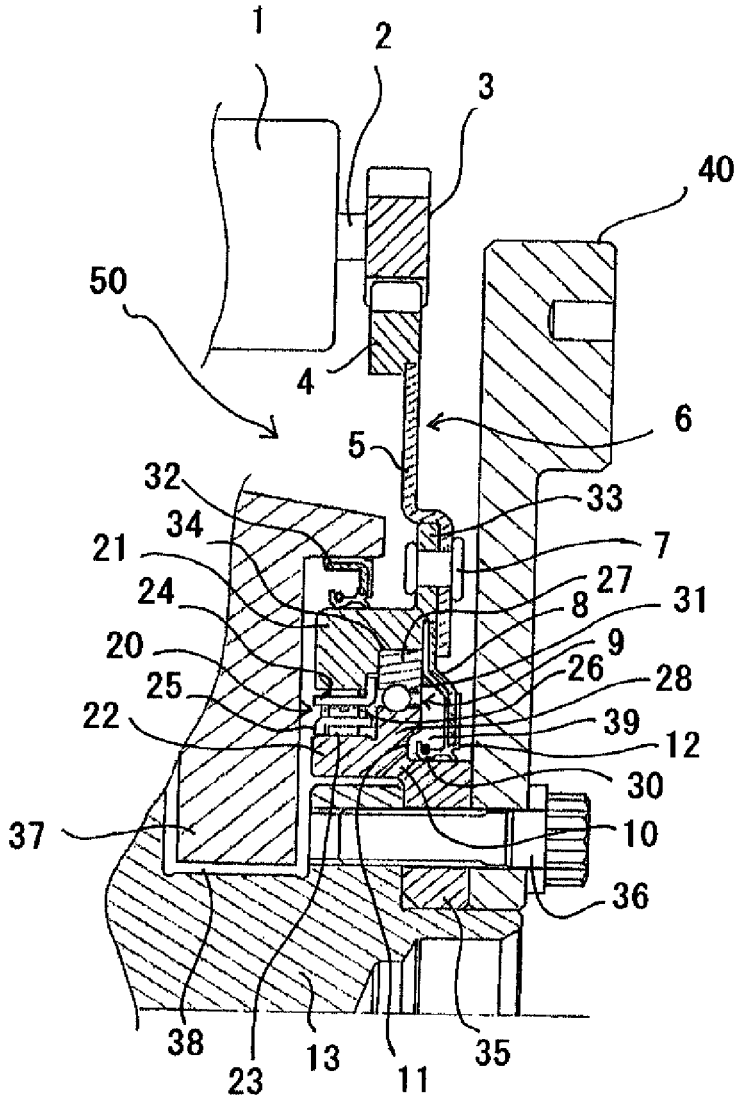
1
2
3
40
50
4
6
5
32
33
34
7
21
27
24
8
31
20
9
26
25
28
22
39
12
30
37
10
36
38
23
13
11
35

ENGINE STARTER MECHANISM USING ONE WAY CLUTCH

BACKGROUND OF THE INVENTION

1. Field of the Invention

The present invention relates to an engine starter mechanism using a one way clutch for use in a vehicle or the like.

2. Description of the Related Art

Usually in an engine starter mechanism using a one way clutch, a starter motor is constantly meshed with a ring gear to transmit, through the one way clutch, a rotating force of the starter motor from the ring gear connected to an outer race of the one way clutch to a crank shaft of an engine (connected to an inner race of the one way clutch), thereby starting the engine. After the start of the engine, the crank shaft overruns, and is synchronized with rotation of the engine, whereby the ring gear is stopped.

The one way clutch has a function of preventing the starter motor from being driven at an excessively high speed after the start of the engine.

In the engine starter mechanism using the conventional one way clutch, the outer race of the one way clutch which transmits a driving force from the starter motor to the crank shaft of the engine includes a flange portion which extends in an axial direction. This constitution includes an oil seal interposed between this flange portion and the inner race of the one way clutch.

However, the flange portion extending in the axial direction is disposed so as to acquire a space where the oil seal is interposed, and hence a length of the engine starter mechanism in the axial direction cannot be shortened, which has caused problems in space saving and cost reduction.

SUMMARY OF THE INVENTION

Therefore, an object of the present invention is to provide an engine starter mechanism using a one way clutch in which a length of the engine starter mechanism in an axial direction is shortened, whereby space saving and cost reduction can be achieved.

To achieve the above object, according to the present invention, there is provided an engine starter mechanism using a one way clutch, comprising: a starter motor; a ring gear for receiving a driving force from the starter motor; the one way clutch including an outer race, an inner race disposed away from the outer race in a radially inner direction and relatively rotatably disposed concentrically with the outer race, and a torque transmitting section disposed between the outer race and the inner race to transmit a torque; and an oil seal for sealing the one way clutch, wherein the ring gear is connected to the outer race of the one way clutch, and the oil seal is held between the ring gear and the outer race.

According to the present invention, an effect can be obtained as follows. There can be provided an engine starter mechanism using a compact one way clutch which can shorten a length of the engine starter mechanism in an axial direction and which is excellent in space saving and cost performance.

Further features of the present invention will become apparent from the following description of exemplary embodiments with reference to the attached drawing.

BRIEF DESCRIPTION OF THE DRAWINGS

The FIGURE is an axially partially sectional view of an engine starter mechanism using a one way clutch showing an embodiment of the present invention.

DESCRIPTION OF THE EMBODIMENT

A preferred embodiment of the present invention will now be described in detail in accordance with the accompanying drawing.

Hereinafter, the present invention will be described in detail with reference to the drawing. It is to be noted that needless to say, an embodiment described hereinafter will be explained as an illustration of the present invention, and does not limit the present invention.

The FIGURE is an axially partially sectional view of an engine starter mechanism using a one way clutch showing an embodiment of the present invention. As shown in the FIGURE, an engine starter mechanism 50 using a one way clutch 20 includes a starter motor 1 which is an electromotive motor to be driven by a power supplied from a power source (not shown), a ring gear 6 which receives a driving force from the starter motor 1, the one way clutch 20, and an oil seal 12 which seals the one way clutch 20.

The ring gear 6 includes a gear portion 4 constantly meshed with a gear 3 fixed to a rotary shaft 2 of the starter motor 1, and a plate portion 5 to which the gear portion 4 is fixed. Between the ring gear 6 and a crank shaft 13 of an engine (not shown), the one way clutch 20 is disposed. The one way clutch 20 includes an outer race 21, an inner race 22 disposed away from the outer race 21 in a radially inner direction and relatively rotatably disposed concentrically with the outer race, and a torque transmitting section disposed between the outer race 21 and the inner race 22 to transmit a torque.

The outer race 21 integrally includes a flange portion 33 disposed at one end in an axial direction and extending in a radially outer direction. On a radially inner side of the outer race 21, the inner race 22 is disposed. Between the outer race 21 and the inner race 22, there is disposed the torque transmitting section including a plurality of sprags 23 which are torque transmission members engaged with the inner and outer races to transmit the torque between the inner race and the outer race, an outer holder 24 and an inner holder 25 which hold the sprags 23, and a ribbon spring 26 which applies a rising moment to the sprags 23.

On a radially inner side of the inner race 22, a radially inner flange portion 35 is disposed, and fixed to the crank shaft 13 of the engine by a bolt 36. Moreover, on a radially outer side of the inner race 22, a radially outer flange portion 28 is disposed, and the radially outer flange portion 28 becomes an inner race of a bearing 9. The radially inner flange portion 35 and the radially outer flange portion 28 are disposed integrally with the inner race 22. A fly wheel 40 is fixed to the crank shaft 13.

An outer race 27 of the bearing 9 disposed by the one way clutch 20 fits into a stepped portion 34 of the outer race 21 of the one way clutch 20. The bearing 9 is incorporated in the one way clutch 20. Therefore, a length of the engine starter mechanism 50 in the axial direction is shortened, and space saving can be realized.

The flange portion 33 of the outer race 21 of the one way clutch 20 is connected to the plate portion of the ring gear 6 through a rivet 7. At this time, a radially outer portion 8 of the oil seal 12 disposed adjacent to the bearing 9 is held between the plate portion 5 and the outer race 21 and between the plate portion 5 and an axial end face 31 of the outer race 27 of the bearing 9. Therefore, a space for the oil seal 12 can be minimized, and hence the length of the engine starter mechanism 50 in the axial direction is further shortened as compared with a conventional mechanism, whereby the space saving can be realized. Moreover, any additional member for fixing the oil seal 12 is not necessary, which can decrease the number of parts and save cost.

On a side of the one way clutch 20 opposite to the oil seal 12 in the axial direction, a member 37 which forms a passage of a lubricant is disposed, to form an oil path 38 through which the lubricant is supplied. The lubricant is supplied to the oil path 38 by an oil pump (not shown), thereby lubricating the one way clutch 20 and the bearing 9 through the oil path 38.

The lubricant supplied through the oil path 38 passes through a through hole 10 disposed in the inner race 22 of the one way clutch 20, to flow into a sealed space 39 defined by the oil seal 12 and the bearing 9, thereby lubricating the bearing 9. On the other hand, the oil path 38 extends in a radially outer direction so as to lubricate the one way clutch 20, and is sealed with a second oil seal 32 disposed between the member 37 and the outer race 21 of the one way clutch 20.

In the vicinity of the through hole 10 of the inner race 22 of the one way clutch 20, a recess portion 11 is disposed, and in the recess portion 11, a lip portion 30 of the oil seal 12 is contained. In consequence, the space saving in the axial direction can be realized.

The outer race 27 of the bearing 9 faces a clutch portion of the one way clutch 20 in the axial direction. In consequence, the outer race 27 performs a function of a stopper in the axial direction, whereby the clutch portion of the one way clutch 20 is prevented from dropping down in the axial direction.

The engine starter mechanism having the above constitution operates as follows. The starter motor 1 is constantly meshed with the gear portion 4 of the ring gear 6. In this state, when the starter motor 1 is driven by a driving source (not shown), a rotating force of the motor is transmitted to the outer race 21 of the one way clutch 20 through the gear 3 meshed with the gear portion 4.

The driving force from the outer race 21 is transmitted to the inner race 22 through the clutch portion, and transmitted to the crank shaft 13 fixed to the inner race 22. In consequence, the engine is started. After the start of the engine, the crank shaft 13 overruns, and is synchronized with rotation of the engine, whereby the one way clutch 20 idles, and the ring gear 6 is stopped. Therefore, after the start of the engine, the starter motor is prevented from being driven at an excessively high speed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-095688, filed Apr. 19, 2010, which is hereby incorporated by reference herein in its entirety.

What is claimed is:

1. An engine starter mechanism using a one way clutch, comprising:

a starter motor;

a ring gear for receiving a driving force from the starter motor;

the one way clutch including an outer race, an inner race disposed away from the outer race in a radially inner direction and relatively rotatably disposed concentrically with the outer race, and a torque transmitting section disposed between the outer race and the inner race to transmit a torque; and an oil seal for sealing the one way clutch, wherein the ring gear is connected to the outer race of the one way clutch, and a radially outer portion of the oil seal is held between the ring gear and an axial end of the outer race and in contact with the axial end of the outer race.

2. The engine starter mechanism according to claim 1, wherein a bearing is disposed between the outer race and the inner race of the one way clutch, and the bearing is sealed together with the one way clutch by the oil seal.

3. The engine starter mechanism according to claim 2, wherein an inner race of the bearing is the inner race of the one way clutch.

4. The engine starter mechanism according to claim 1, wherein the end face of the inner race of the one way clutch in an axial direction is provided with a recess portion, and in the recess portion, a lip portion of the oil seal is contained.

5. The engine starter mechanism according to claim 1, wherein an outer race of the bearing faces the clutch portion of the one way clutch in an axial direction.

* * * * *